US012571276B1

(12) United States Patent
Cotton et al.

(10) Patent No.: US 12,571,276 B1
(45) Date of Patent: Mar. 10, 2026

(54) CASING MANDREL HANGERS

(71) Applicant: Patriot Research Center, LLC, Houston, TX (US)

(72) Inventors: Craig Cotton, Houston, TX (US); Michael Lacheny, Houston, TX (US); Brandon Cain, Houston, TX (US)

(73) Assignee: Patriot Research Center, LLC, Houston, TX (US)

( * ) Notice: Subject to any disclaimer, the term of this patent is extended or adjusted under 35 U.S.C. 154(b) by 0 days.

(21) Appl. No.: 19/192,883

(22) Filed: Apr. 29, 2025

(51) Int. Cl.
*E21B 33/04* (2006.01)

(52) U.S. Cl.
CPC ..... *E21B 33/04* (2013.01); *E21B 2200/01* (2020.05)

(58) Field of Classification Search
CPC ..... E21B 33/04
See application file for complete search history.

(56) References Cited

U.S. PATENT DOCUMENTS

2012/0305269 A1* 12/2012 Bories ..... E21B 33/043 166/208
2016/0186523 A1* 6/2016 Nguyen ..... E21B 33/0422 166/77.51
2021/0363861 A1* 11/2021 Cotton ..... E21B 17/0465
2022/0127913 A1* 4/2022 Armistead ..... E21B 41/0035

* cited by examiner

*Primary Examiner* — Giovanna Wright
(74) *Attorney, Agent, or Firm* — Troutman Pepper Locke LLP; Daniel Nguyen; Joshua L. Jones

(57) ABSTRACT

A running tool has a core and a sleeve rotatably engaged to the core with a first ratchet mechanism. A ratchet ring engaged inward of an inward surface of the sleeve is configured to form a second ratchet mechanism with a set of ratchet teeth of a solid body hanger. The solid body hanger is a single, solid piece. An inward biased lock ring is operatively connected to an actuator to energize outwardly to secure the solid body hanger in a wellhead housing. The solid body hanger includes a shoulder with a weight sealing surface configured to form a metal-to-metal seal with the solid hanger body landed out in a casing head housing A single trip downhole and back for the running tool can both land out the hanger and engage the lock ring.

16 Claims, 6 Drawing Sheets

CASING MANDREL HANGERS

BACKGROUND

1. Field

The present disclosure relates to equipment for drilling and production, and more particularly to casing mandrel hangers for use in drilling geological formations and production therefrom of gas, oil, and the like.

2. Description of Related Art

Solid body casing mandrel hangers traditionally require a snap ring to engage in the housing for retention. The only confirmation that a hanger has been properly locked in is from pulling the casing string weight plus about 50,000 lbs of additional equipment and components. The typical solid body hanger has elastomeric isolation seals. Problems arise when the seals get damaged during installation, wherein the complete string has to be picked up and brought to the rig floor to redress the hanger seals.

Traditionally, running a long lateral production string requires rotation to ensure that the hanger will land out. This is traditionally achieved via milled grooves cut into the hanger neck with retractable single direction dogs in the tool to provide the rotational torque. However, with a traditional biased inward locking mechanism, a single point of torque is not possible. Hangers with biased inward lock rings typically take two trips, one trip to land the hanger and remove the landing joint, and one to engage the biased inward lock ring.

The conventional techniques have been considered satisfactory for their intended purpose. However, there is an ever-present need for improved systems and methods for casing mandrel hangers. This disclosure provides a solution for this need.

SUMMARY

A casing mandrel hanger includes a solid body hanger defining an axial bore therethrough along a rotation axis bounded by an inward facing bore surface, and an outward facing sealing surface. The solid body hanger is a single, solid piece bounded by the inward facing surface, the outward facing sealing surface, a first axial end surface, and an opposed second axial end surface. An inward biased lock ring is operatively connected to an actuator to energize outwardly to secure the solid body hanger in a wellhead housing.

The solid body hanger can include a shoulder with a weight sealing surface configured to form a metal-to-metal seal with the solid hanger body landed out. A casing with a landing surface can be engaged against the weight sealing surface as the metal-to-metal seal to prevent flow of fluids around the outward facing sealing surface in either up hole or down hole direction. Weight bearing in the down hole direction on the solid body hanger can bias the weight sealing surface toward the landing surface.

The solid body hanger can include a first set of threads proximate the first axial end surface. A second set of threads can be proximate the inward biased lock ring. The second set of threads can be threaded in an opposite direction from that of the first set of threads.

The actuator can include a drive ring threaded to the second set of threads. The drive ring can be wedged between the second set of threads and the inward biased lock ring to energize the lock ring by advancing along the second set of threads towards the second end surface.

The drive ring can include a plurality of axially extending receiving slots configured to receive torque tines of a running tool for driving threading rotation of the drive ring. The solid body hanger can define an annular shelf surface radially inward relative to the second set of threads. The annular shelf surface can face axially toward the first axial end surface. A set of ratchet teeth can extend radially around the shelf surface, configured to lock with a ratchet ring of a running tool for driving rotation of the solid body hanger in a first rotational direction and sliding relative to the solid body hanger in a second rotational direction opposite the first rotational direction.

A system includes a running tool. The running tool includes a core defining a rotation axis. A sleeve is rotatably engaged to the core with a first ratchet mechanism configured to provide a torque path from the core to the sleeve in a first rotation direction about the rotation axis, and to allow relative rotation in a second rotation direction opposite the first rotation direction. A ratchet ring is engaged inward of an inward surface of the sleeve configured to form a second ratchet mechanism with a set of ratchet teeth of a solid body hanger.

The system can include the solid body hanger. The solid body liner can define an axial bore therethrough along the rotation axis bounded by an inward facing bore surface, and an outward facing sealing surface. The solid body hanger can be a single, solid piece bounded by the inward facing surface, the outward facing sealing surface, a first axial end surface, and an opposed second axial end surface. An inward biased lock ring can be operatively connected to an actuator to energize outwardly to secure the solid body hanger in a wellhead housing. The solid body hanger can include a weight sealing surface configured to form a metal-to-metal seal with the solid hanger body landed out.

The solid body hanger can include a first set of threads proximate the first axial end surface threaded to corresponding threads of the running tool and a second set of threads proximate the inward biased lock ring. The second set of threads can be threaded in an opposite direction from that of the first set of threads. The actuator can include a drive ring threaded to the second set of threads. The drive ring can be wedged between the second set of threads and the inward biased lock ring to energize the lock ring by advancing along the second set of threads towards the second end surface. The drive ring can include a plurality of axially extending receiving slots engaged to torque tines of the sleeve of the running tool for driving threading rotation of the drive ring.

The solid body hanger can define an annular shelf surface radially inward relative to the second set of threads. The annular shelf surface can face axially toward the first axial end surface. A set of ratchet teeth can extend radially around the shelf surface, configured to lock with the ratchet ring of the running tool for driving rotation of the solid body hanger in a first rotational direction and sliding relative to the solid body hanger in a second rotational direction opposite the first rotational direction.

The first ratchet mechanism can include a plurality of retractable dogs extending radially outward from the core. The sleeve can define a plurality of slots, wherein the plurality of dogs cam engage in the plurality of slots for rotation in the first rotation direction for transfer of torque from the core to the sleeve. Angled surfaces of the plurality of dogs can slide relative to the slots allowing for relative rotation of the core in the second rotation direction relative to the sleeve. A shear pin can engage the sleeve to the core.

The shear pin can be configured to provide a torque path for the core to drive the sleeve, torque tines, and drive ring in the second rotation direction.

A method includes landing out a solid body hanger and locking the solid body hanger in a wellhead housing by engaging an inward biased lock ring of the solid body against the wellhead housing. The landing out and the engaging the inward biased lock ring are accomplished in a single trip of a running tool downhole and back.

Prior to landing out the solid body hanger, the method can include rotating a core of the running tool in a first rotational direction about a rotation axis of the running tool to thread the core to the solid body hanger with the solid body hanger remaining stationary relative to the rotating core. After the core and casing hanger are threaded together, the core can transmit torque to the solid body hanger to rotate the core and the solid body hanger together until the solid body liner lands out.

After landing out the solid body hanger, the core and sleeve of the running tool can rotate in a second rotational direction opposite the first rotational direction to drive a drive ring downward and wedge it against an inside surface of the inward biased lock ring to energize the inward biased lock ring and can press it out against a wellhead housing to lock the solid bod hanger in place against movement upward or downward relative to the wellhead housing.

The method can include breaking a shear pin in response to torque rising above a predetermined threshold due to the inward biased lock ring energizing to a predetermined level. After breaking the shear pin, the method can include rotating the core relative to the sleeve in the second rotation direction to unthread from the solid body hanger with continued rotation of the core relative to the sleeve. After unthreading the core from the solid body hanger, the method can include retrieving the running tool and leaving the casing hanger in place landed out.

Landing out the solid body hanger can include forming a metal-to-metal seal by engagement of the solid body seal to the wellhead housing. This metal-to-metal seal can seal by weight force on the solid body hanger and backs up one or more elastomeric seals of the solid body hanger to help ensure no fluid flows either way around an outside of the solid body hanger.

These and other features of the systems and methods of the subject disclosure will become more readily apparent to those skilled in the art from the following detailed description of the disclosed embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
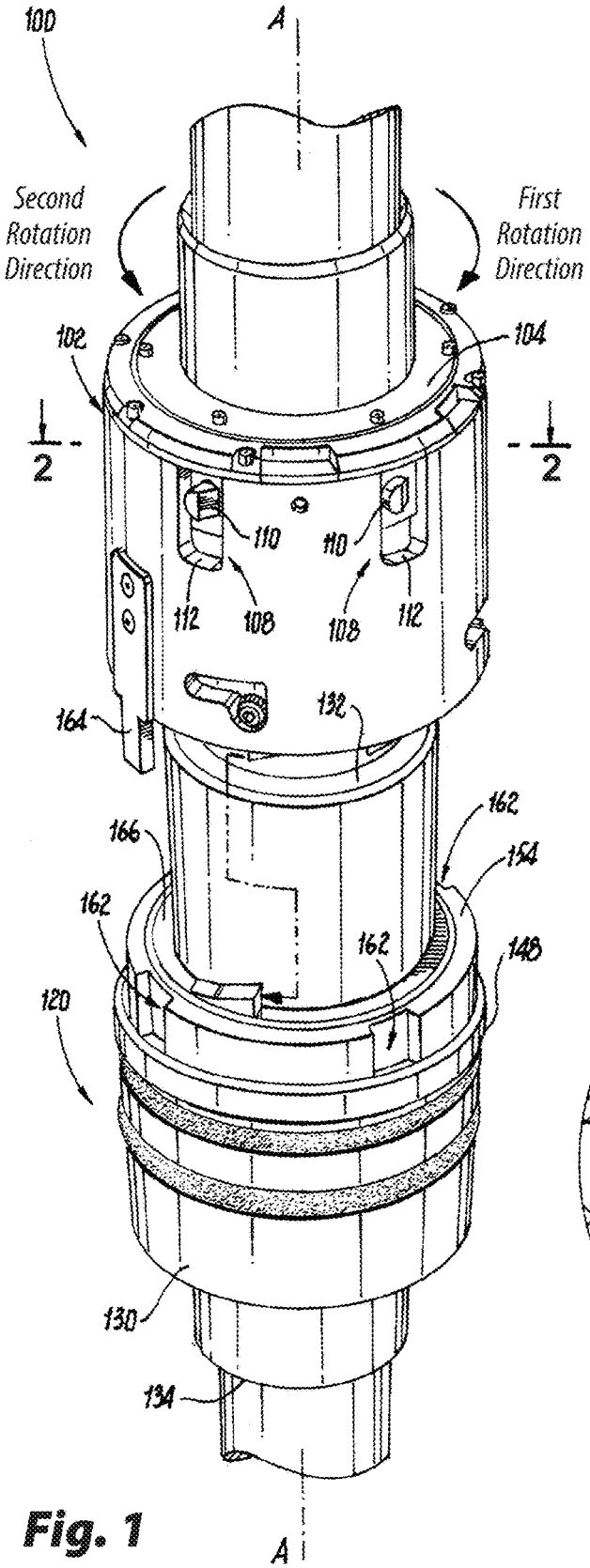
FIG. 1 is a schematic perspective view of an embodiment of a system constructed in accordance with the present disclosure, showing the running tool and the solid body hanger.

Reference will now be made to the drawings wherein like reference numerals identify similar structural features or aspects of the subject disclosure. For purposes of explanation and illustration, and not limitation, a partial view of an embodiment of a system in accordance with the disclosure is shown in FIG. 1 and is designated generally by reference character 100. Other embodiments of systems in accordance with the disclosure, or aspects thereof, are provided in FIGS. 2-9, as will be described. The systems and methods described herein can be used to land out a solid body hanger and lock it in place with an inward biased locking ring using a single trip of a running tool.

The system 100 includes a running tool 102. The running tool includes a core 104 defining a rotation axis A. A sleeve 106 is rotatably engaged to the core 104 with a first ratchet mechanism 108 configured to provide a torque path from the core 104 to the sleeve 106 in a first rotation direction about the rotation axis, e.g., clockwise when viewed from above as oriented in FIG. 1. The first ratchet mechanism 108 allows relative rotation in a second rotation direction opposite the first rotation direction, e.g. counterclockwise as viewed from above as oriented in FIG. 1.

Figure 2:
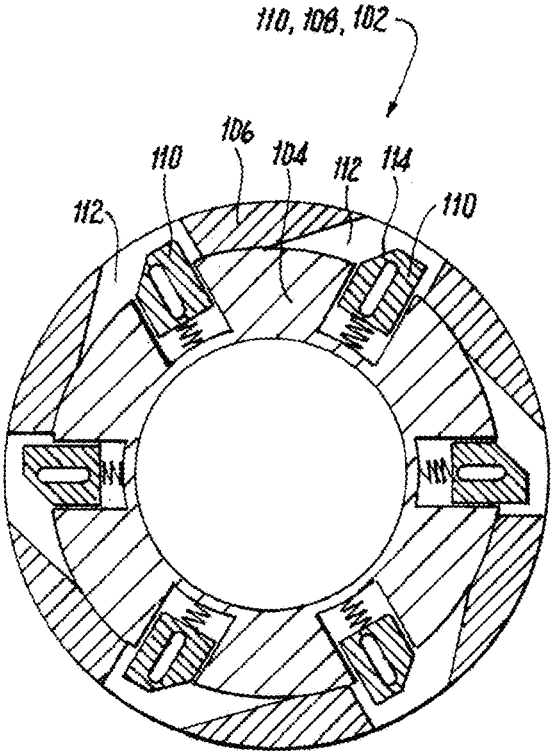
FIG. 2 is a schematic cross-sectional plan view of the system of FIG. 1, showing the retractable dogs of the upper ratchet.

With reference now to FIG. 2, the first ratchet mechanism 108 includes a plurality of retractable, e.g. spring loaded, dogs 110 extending radially outward from the core 104. The sleeve 106 defines a plurality of slots 112, wherein the dogs 110 engage in the slots 112 for rotation in the first rotation direction for transfer of torque from the core 104 to the sleeve 106. An angled surface 114 of each of the dogs slides relative to the slots 112, allowing for relative rotation of the core 104 in the second rotation direction relative to the sleeve 106.

Figure 3:
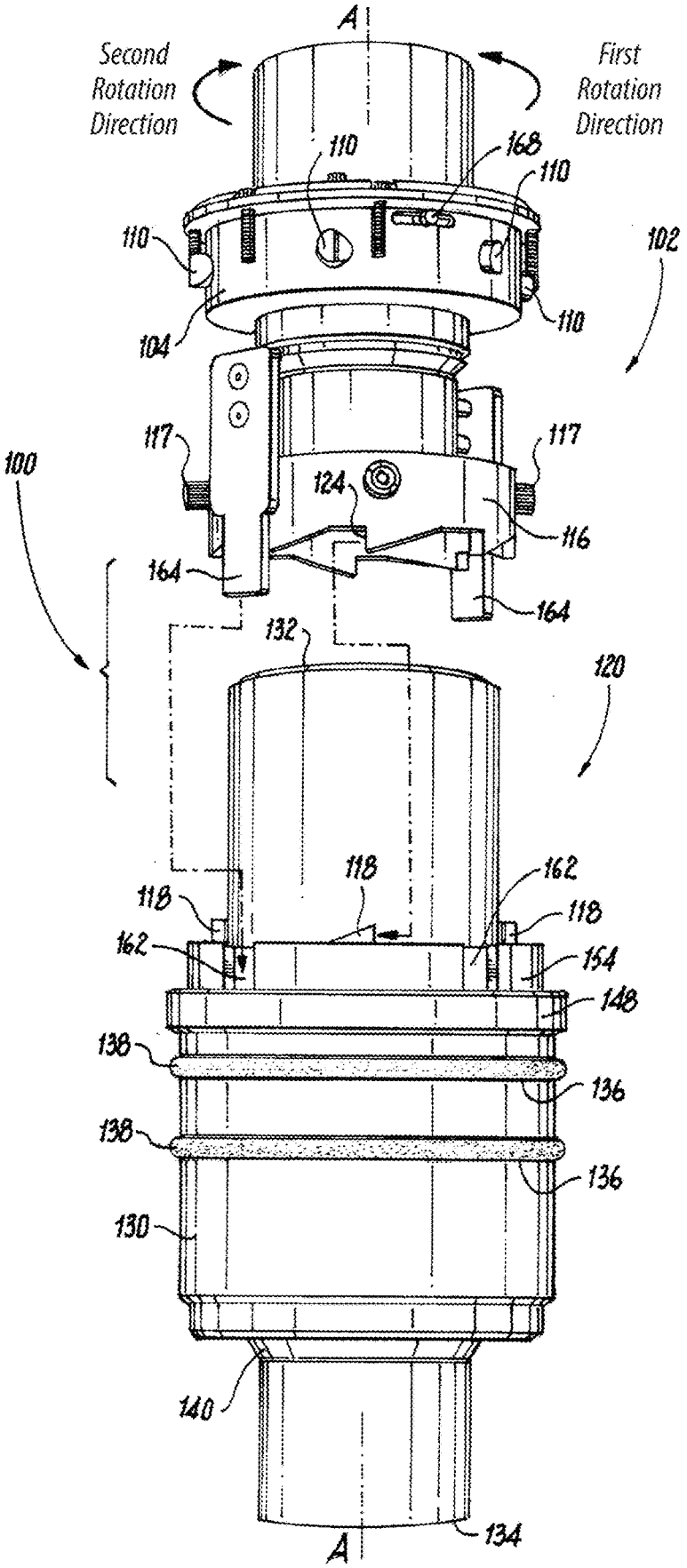
FIG. 3 is a schematic perspective view of the system of FIG. 1, showing the sleeve of the running tool removed to show the ratchet ring of the lower ratchet.
Figure 4:
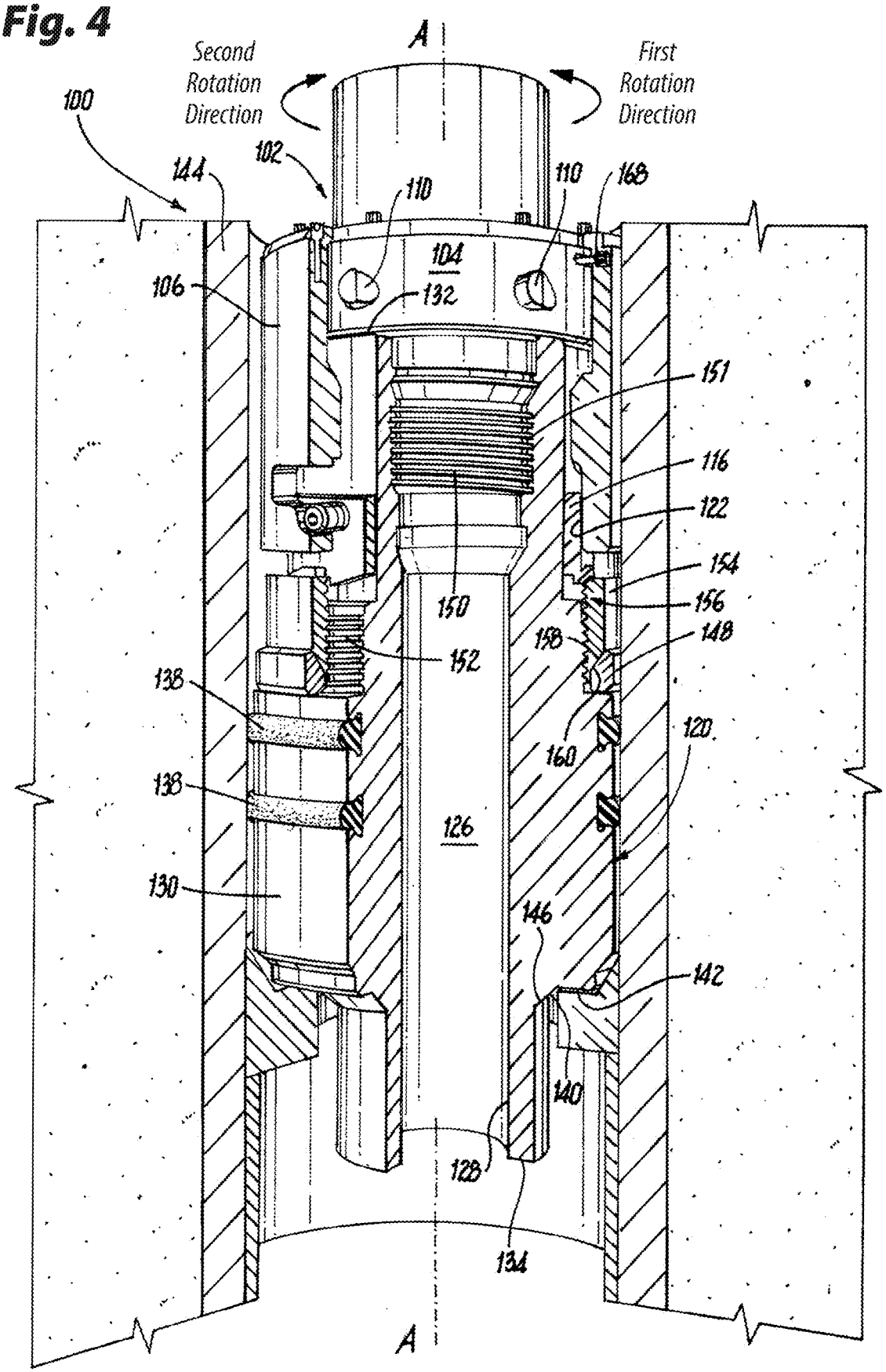
FIG. 4 is a schematic cross-sectional perspective view of the system of FIG. 1, showing the solid body hanger landed out.

Referring now to FIG. 3, a ratchet ring 116 is engaged inward of an inward surface 122 of the sleeve 106 (shown in FIG. 4). The ratchet ring 116 engages the sleeve 106 with cap screws 117. The cap screws 117 are located on the ratchet ring 116 to provide retention and when rotated clock wise, the cap screws 117 form part of the torque path from the landing joint, torque dogs 110, sleeve 106, ratchet ring 116, to ratchet teeth 118. The ratchet ring 116 forms a second ratchet mechanism, engaging teeth 124 of the ratchet ring 116 with a set of ratchet teeth 118 of a solid body hanger 120.

With reference now to FIG. 4, the system 100 includes the solid body hanger 120, which can be used as a casing hanger for downhole drilling and production, including wellbores with horizontal sections. The casing hanger 120 defines an axial bore 126 therethrough along the rotation axis A bounded by an inward facing bore surface 128, and an outward facing sealing surface 130. The solid body hanger 120 is a single, solid piece bounded by the inward facing surface 128, the outward facing sealing surface 130, a first axial end surface 132, and an opposed second axial end surface 134. One or more seal seats 136 for elastomeric seals 138 (labeled in FIG. 3) are defined in the outward facing sealing surface 130, circumscribing the rotational axis A axially between the lock ring 148 and the weight sealing surface 140.

The solid body hanger includes a shoulder 142 with the weight sealing surface 140 that forms a metal-to-metal seal against a wellhead housing 144 when the hanger 120 is landed out. The weight sealing surface 140 is a conical surface converging toward the second axial end surface 134, on the load shoulder 142 that is axially between the lock ring 148 and the second axial end surface 134, relative to the rotation axis A. The casing 144, e.g. a wellhead housing, has a landing surface 146 engaged against the weight sealing surface 140, forming the metal-to-metal seal to prevent flow of fluids around the outward facing sealing surface 130 in either up hole or down hole direction, e.g., as a backup in case the elastomeric seals 138 (labeled in FIG. 3) are damaged. Weight bearing in the down hole direction (downward as oriented in FIG. 4) on the hanger 120 biases the weight sealing surface 140 toward the landing surface 146.

The hanger 120 includes a first set of female, right hand threads 151 proximate the first axial end surface 132 that can be threaded to corresponding male, right hand threads 150 of the running tool 102. The hanger 120 includes a second set of threads 152 proximate the lock ring 148. The second set of threads 152 is a set of male, left hand threads. The lock ring 148 is an inward biased lock ring and is operatively connected to an actuator to energize outwardly to secure the solid body hanger 120 in a casing 144. The actuator includes a drive ring 154 with female left-hand threads 156 threaded to the second set of threads 152. The drive ring 154 is wedged, with mutual wedging surfaces 158, 160 of the drive and lock rings 154, 148, between the second set of threads and the inward biased lock ring 148 to energize the lock ring 148 by advancing the drive ring 154 along the second set of threads 152 towards the second end surface 134. The drive ring 154 includes a plurality of axially extending receiving slots 162 (labeled in FIG. 1) that engage torque tines 164 (labeled in FIGS. 1-2) of the sleeve 106 of the running tool 102 for driving threading rotation of the drive ring 154.

The hanger 120 defines an annular shelf surface 166 (labeled in FIG. 1) radially inward relative to the second set of threads 152. The annular shelf surface 166 faces axially toward the first axial end surface 132. The set of ratchet teeth 118 extends radially around the shelf surface, configured to lock with the ratchet ring 116 of the running tool 102 for driving rotation of the hanger 120 in the first rotational direction, e.g., clockwise around the rotation axis A as viewed from above as oriented in FIG. 4, and for sliding relative to the hanger 120 in a second rotational direction, e.g., counter clockwise when driving the drive ring 154.

A shear pin 168 extends in a radial direction relative to the rotation axis A, engaging the sleeve 106 to the core 104. The shear pin 168 is configured to provide a torque path for the core 104 to drive the sleeve 106, torque tines 164, and drive ring 154 in the second rotation direction, e.g., counter clockwise as viewed from above as oriented in FIG. 4, until the drive ring 154 develops a predetermined torque at which the shear pin 168 is configured to shear, freeing the sleeve 106 for rotation relative to the core 104. After the shear pin 168 shears, the sleeve 106, torque tines 164, and drive ring 154 can remain stationary as the core 104 continues to rotate in the second rotation direction to unthread the upper threads 150, 151, for removal of the running tool 102 from the solid body hanger 120. The foregoing structures advantageously allow the running tool to make a single trip downhole and back to both land out the hanger 120 and engage the lock ring 148.

Figure 5:
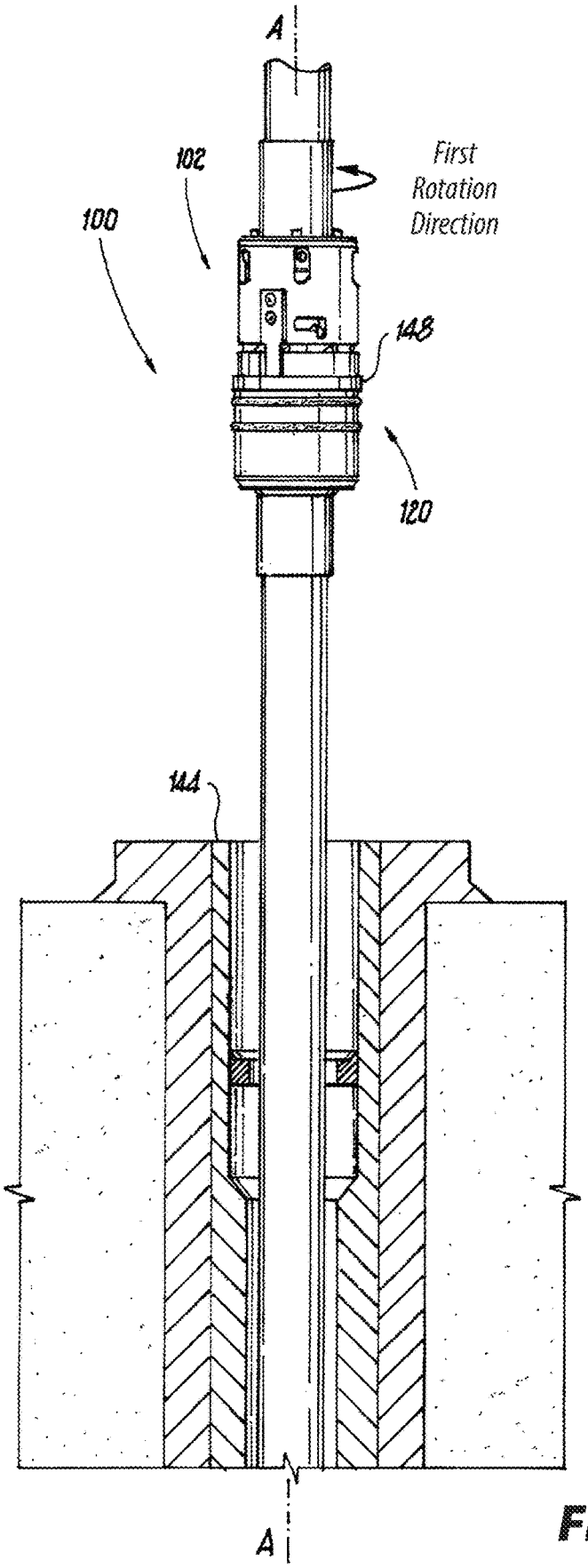
FIGS. 5-9 are schematic side elevation views of stages of a method of landing out a solid body hanger and energizing the inward biased lock ring in a single trip of the running tool.
Figure 6:
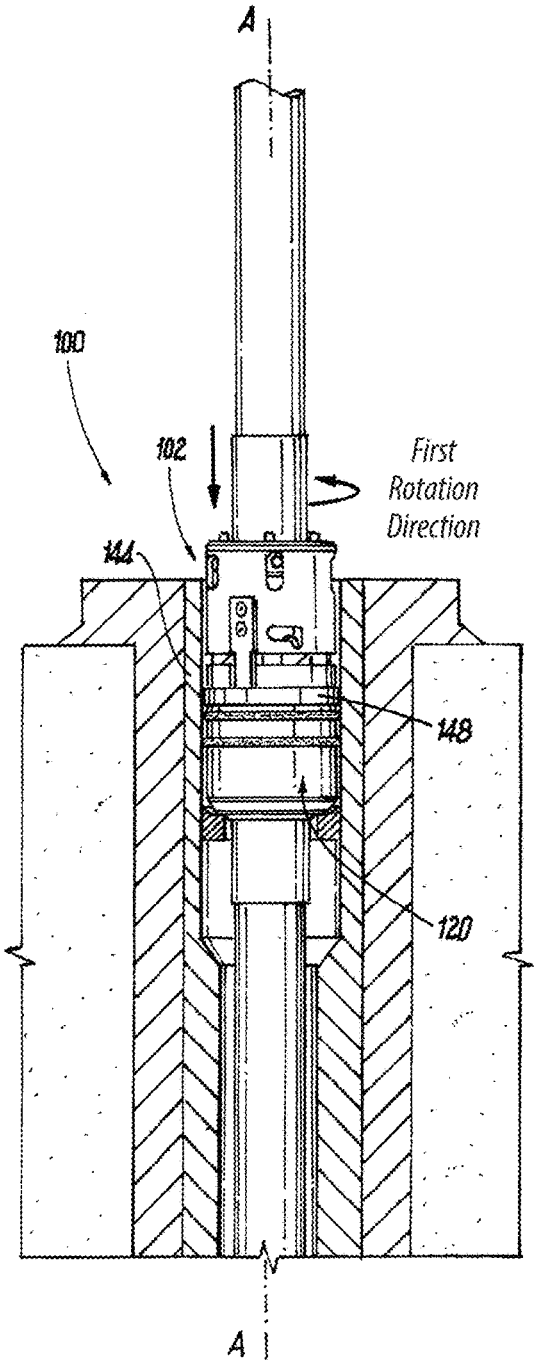

With reference now to FIG. 5, methods are provided for landing out a solid body hanger 120 and locking the hanger 120 in a wellhead housing 144 by engaging an inward biased lock ring 148 of the hanger 120 against the casing 144 in a single trip of the running tool 102 downhole and back. Prior to landing out the hanger 120, the method includes rotating the core 104 (labeled in FIG. 1) of the running tool 102, e.g., using drilling rig, in a first rotational direction about a rotation axis A of the running tool, e.g., clockwise as described herein, to thread the core 104 of the running tool to the right hand threads 150 (labeled in FIG. 4) of the hanger 120 with the hanger 120 remaining stationary relative to the rotating running tool 102. The rotation arrow in FIG. 5 indicates the threading rotation. Thereafter, as indicated by the arrows in FIG. 6, the running tool 102 is operatively connected to the hanger 120 to rotate together with the hanger 120 (and any liner suspended therefrom) in the first direction until the hanger 120 lands out downhole, e.g., in the wellhead housing 144. While the running tool 102 is driving the hanger 120 (and any equipment strung to the hanger 120) in the first rotation direction, the torque path is from the core 104 of the tool 102, to the dogs 110 and to the threads 151, to the sleeve 106, to the cap screws 117 and ratchet ring 116, to the ratchet teeth 118 and solid body hanger 120, as labeled in FIG. 3.

During make up of the running tool 102 to the casing hanger 120, the torque blades 164 are removed from the sleeve 106. Once the tool running 102 has been made up, the running tool 102 is backed off of the casing hanger face one-half turn. The receiving slots 162 of the drive ring 154 are aligned to the torque blade grooves of the sleeve 106. Once the drive ring 154 and sleeve 106 are thus aligned, the torque blades 164 are bolted onto the sleeve 106, seated in both the torque blade grooves of the sleeve 106 and the receiving slots 162 of the drive ring 154.

Figure 7:
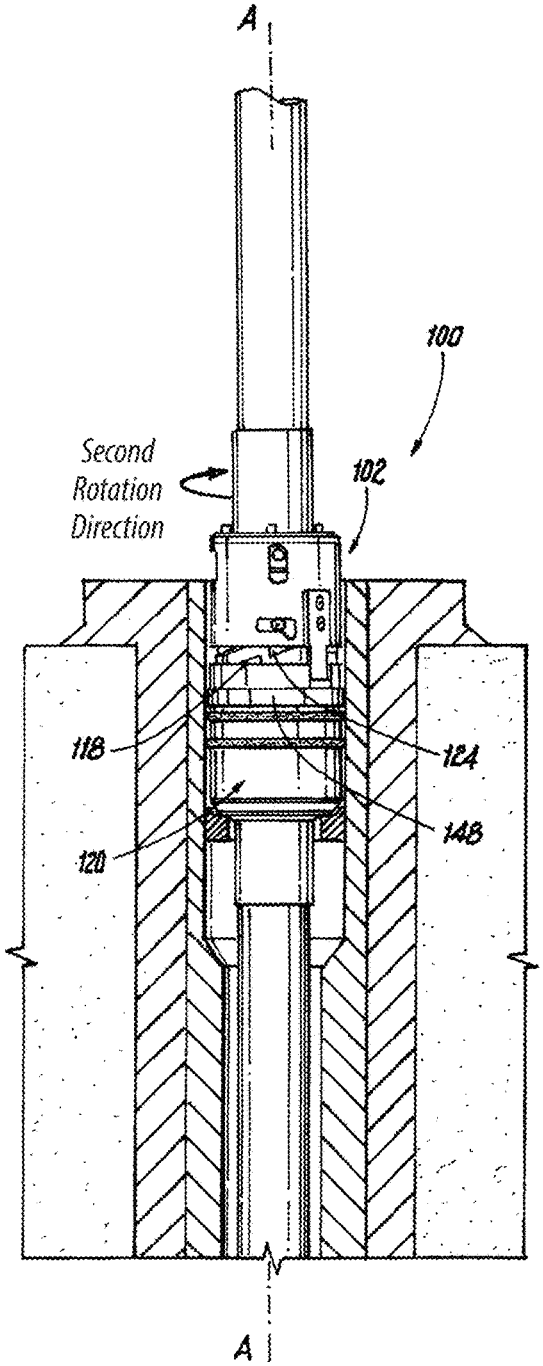

Referring now to FIG. 7, after landing out the hanger 120, the core 104 and sleeve 106 (labeled in FIG. 4) of the running tool rotate in a second rotational direction, e.g., counterclockwise, transmitting torque with the shear pin 168 (labeled in FIG. 4) until it breaks. During this rotation, the ratchet ring 116 (labeled in FIG. 4) slips so the casing hanger 120 does not rotate. During the rotation indicated by the rotation arrow in FIG. 7, the torque blades 164 (labeled in FIG. 3) drive the drive ring 154, along the threads 152 (labeled in FIG. 4) to drive the drive ring 154 downward as oriented in FIG. 4 and wedge it against an inside surface of the inward biased lock ring 148. This energizes the lock ring 148 and press it out against a wellhead housing 144, as indicated by the double arrow in FIG. 7, to lock the hanger 120 in place against movement upward or downward relative to the wellhead housing 144 as oriented in FIG. 7. While the running tool is energizing the lock ring 148 as shown in FIG. 7 with rotation in the second rotation direction, the torque path is from the core 104 to the shear pin 168 to the sleeve 106 to the torque tines 164 to the drive ring 154 as labeled in FIG. 3.

Figure 8:
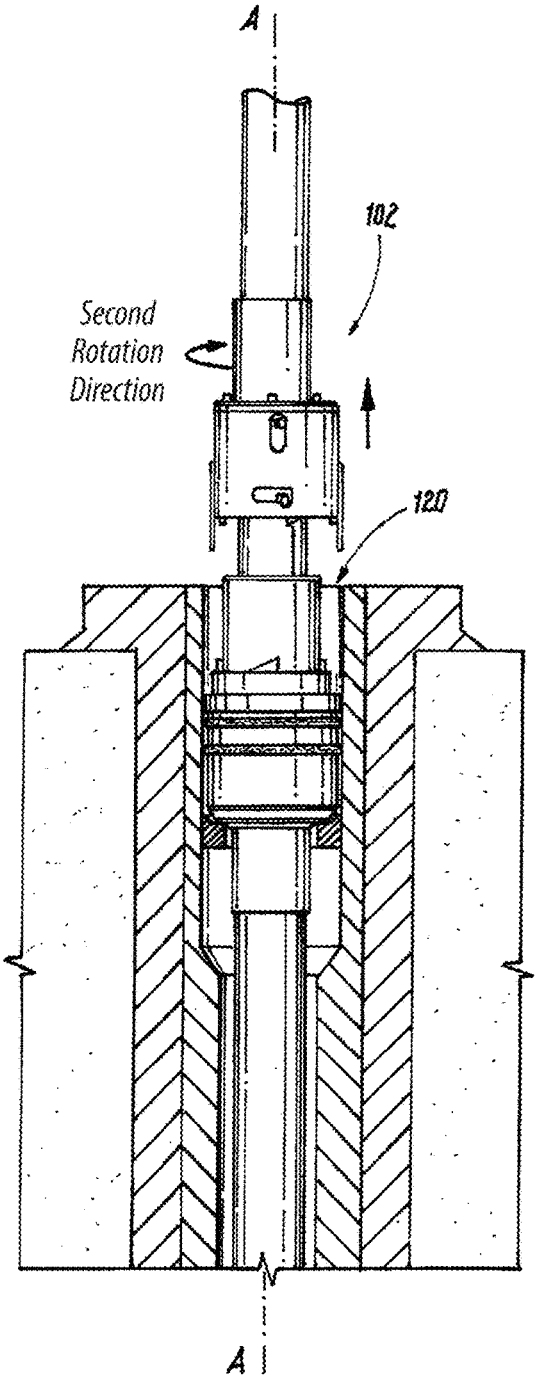
Figure 9:
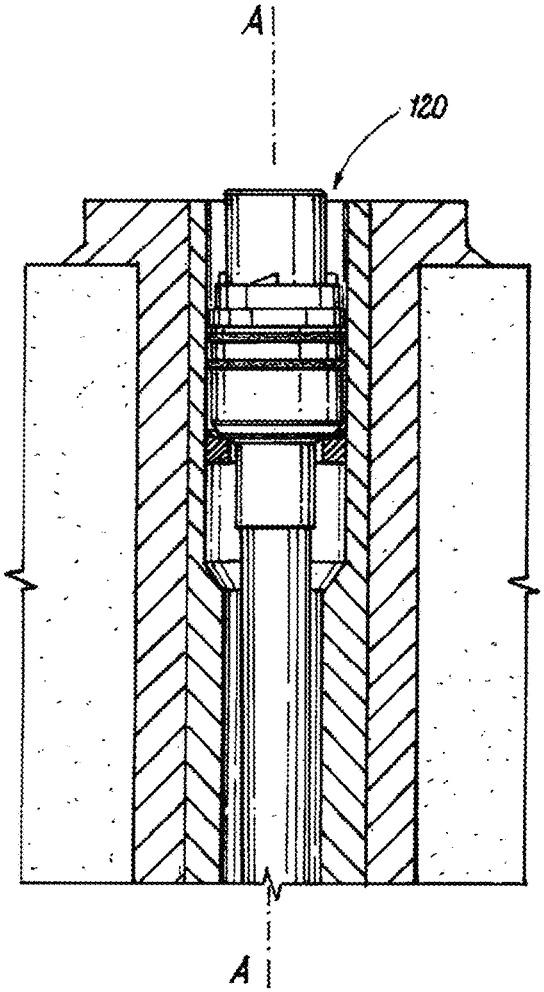

The method includes breaking the shear pin 168 as described above with reference to FIG. 4, in response to torque rising above a predetermined threshold due to the inward biased lock ring 148 energizing to a predetermined level, e.g. 800 ft lbs (1085 N m) or any other suitable torque. As shown in FIG. 8, after breaking the shear pin 168, the method includes rotating the core 104 relative to the sleeve 106 (each labeled in FIG. 1) in the second rotation direction, e.g., counterclockwise. The dogs 110 (labeled in FIGS. 1-2) of the running tool 102 slide, allowing the running tool 102 to unthread the right-hand threads 151 from the solid body hanger 120 with continued counterclockwise rotation of the core 104 relative to the sleeve 106. After unthreading the core 104 from the solid body hanger 120, the method includes retrieving the running tool 102 and leaving the casing hanger 120 in place landed out as shown in FIG. 9. Only a single trip of the running tool 102 downhole is needed to both land out the hanger 120 and lock it in place with the lock ring 148 forming the metal-to-metal seal described above with reference to FIG. 4.

Those skilled in the art will readily appreciate that right hand threads are threaded together with the casing hanger 120 stationary and the running tool 102 rotating clockwise as viewed from above in FIGS. 3-4. Left hand threads are threaded together with the casing hanger 120 stationary relative to the running tool 102 rotating counterclockwise as viewed from above. Winding the right hand or left-hand threads in the opposite directions indicated above will unwind the respective threads.

The methods and systems of the present disclosure, as described above and shown in the drawings, provide for landing out a solid body hanger liner and locking it in place with an inward biased locking ring using a single trip of a running tool. While the apparatus and methods of the subject disclosure have been shown and described with reference to certain embodiments, those skilled in the art will readily appreciate that changes and/or modifications may be made thereto without departing from the scope of the subject disclosure.

What is claimed is:

1. A casing hanger comprising:

a solid body hanger defining an axial bore therethrough along a rotation axis and bounded by an inward facing bore surface and an outward facing sealing surface, wherein the solid body hanger is a single, solid piece bounded by the inward facing surface, the outward facing sealing surface, a first axial end surface, and an opposed second axial end surface; and an inward biased lock ring operatively connected to an actuator to energize outwardly to secure the solid body hanger in a wellhead housing, wherein the solid body hanger includes:

a first set of threads proximate the first axial end surface; and a second set of threads proximate the inward biased lock ring, wherein the second set of threads is threaded in an opposite direction from that of the first set of threads, wherein the solid body hanger defines an annular shelf surface radially inward relative to the second set of threads, wherein the annular shelf surface faces axially toward the first axial end surface, and wherein a set of ratchet teeth extends radially around the shelf surface, the set of teeth configured to lock with a ratchet ring on a running tool for driving rotation of the solid body hanger in a first rotational direction and sliding relative to the solid body hanger in a second rotational direction opposite the first rotational direction.

2. The casing hanger as recited in claim 1, wherein the solid body hanger includes a shoulder with a weight sealing surface configured to form a metal-to-metal seal with the solid hanger body landed out.

3. The casing hanger as recited in claim 1, further comprising a casing with a landing surface engaged against the weight sealing surface as the metal-to-metal seal to prevent flow of fluids around the outward facing sealing surface in either up hole or down hole direction, wherein weight bearing in the down hole direction on the solid body hanger biases the weight sealing surface toward the landing surface.

4. The casing hanger as recited in claim 1, wherein the actuator includes a drive ring threaded to the second set of threads, wherein the drive ring is wedged between the second set of threads and the inward biased lock ring to energize the lock ring by advancing along the second set of threads towards the second end surface.

5. The casing hanger as recited in claim 4, wherein the drive ring includes a plurality of axially extending receiving slots configured to receive torque tines on a running tool for driving threading rotation of the drive ring.

6. A system comprising:

a running tool including:

a core defining a rotation axis;

a sleeve rotatably engaged to the core with a first ratchet mechanism configured to provide a torque path from the core to the sleeve in a first rotation direction about the rotation axis, and to allow relative rotation in a second rotation direction opposite the first rotation direction; and a ratchet ring engaged inward of an inward surface of the sleeve configured to form a second ratchet mechanism with a set of ratchet teeth on a solid body hanger.

7. The system as recited in claim 6, further comprising:

the solid body hanger, wherein the solid body hanger defines an axial bore therethrough along the rotation axis bounded by an inward facing bore surface, and an outward facing sealing surface, wherein the solid body hanger is a single, solid piece bounded by the inward facing surface, the outward facing sealing surface, a first axial end surface, and an opposed second axial end surface; and an inward biased lock ring operatively connected to an actuator to energize outwardly to secure the solid body hanger in a wellhead housing.

8. The system as recited in claim 7, wherein the solid body hanger includes a weight sealing surface configured to form a metal-to-metal seal with the solid hanger body landed out.

9. The system as recited in claim 7, wherein the solid body hanger includes:

a first set of threads proximate the first axial end surface threaded to corresponding threads of the running tool; and a second set of threads proximate the inward biased lock ring, wherein the second set of threads is threaded in an opposite direction from that of the first set of threads.

10. The system as recited in claim 8, wherein the actuator includes a drive ring threaded to the second set of threads, wherein the drive ring is wedged between the second set of threads and the inward biased lock ring to energize the lock ring by advancing along the second set of threads towards the second end surface, and wherein the drive ring includes a plurality of axially extending receiving slots engaged to torque tines of the sleeve of the running tool for driving threading rotation of the drive ring.

11. The system as recited in claim 10, wherein the solid body hanger defines an annular shelf surface radially inward relative to the second set of threads, wherein the annular shelf surface faces axially toward the first axial end surface, and wherein a set of ratchet teeth extends radially around the shelf surface, the set of teeth configured to lock with the ratchet ring of the running tool for driving rotation of the solid body hanger in a first rotational direction and sliding relative to the solid body hanger in a second rotational direction opposite the first rotational direction.

12. The system as recited in claim 10, wherein the first ratchet mechanism includes a plurality of retractable dogs extending radially outward from the core, wherein the sleeve defines a plurality of slots, wherein the plurality of dogs engage in the plurality of slots for rotation in the first rotation direction for transfer of torque from the core to the sleeve, and wherein angled surfaces of the plurality of dogs slide relative to the slots allowing for relative rotation of the core in the second rotation direction relative to the sleeve.

13. The system as recited in claim 12, further comprising a shear pin engaging the sleeve to the core, wherein the shear pin is configured to provide a torque path for the core to drive the sleeve, torque tines, and drive ring in the second rotation direction.

14. A method comprising:

landing out a solid body hanger and locking the solid body hanger in a wellhead housing by engaging an inward biased lock ring of the solid body hanger against the wellhead housing, wherein the landing out and the engaging the inward biased lock ring are accomplished in a single trip of a running tool downhole and back, wherein prior to landing out the solid body hanger, the method includes:

rotating a core of the running tool in a first rotational direction about a rotation axis of the running tool to thread the core to the solid body hanger with the solid body hanger remaining stationary relative to the core; and after the core and casing hanger are threaded together, transmitting torque from the core to the solid body hanger to rotate the core and the solid body hanger together until the solid body hanger lands out, further comprising:

after landing out the solid body hanger, rotating the core and the sleeve of the running tool in a second rotational direction opposite the first rotational direction to drive a drive ring downward and wedge it against an inside surface of the inward biased lock ring to energize the inward biased lock ring and press it out against a wellhead housing to lock the solid body hanger in place against movement upward or downward relative to the wellhead housing.

15. The method as recited in claim 14, further comprising:

breaking a shear pin in response to torque rising above a predetermined threshold due to the inward biased lock ring energizing to a predetermined level;

after the shear pin breaks, rotating the core in the second rotation direction relative to the sleeve from the solid body hanger with continued rotation of the core relative to the sleeve; and after unthreading the core from the solid body hanger, retrieving the running tool and leaving the casing hanger in place landed out.

16. The method as recited in claim 14, wherein landing out the solid body hanger includes forming a metal-to-metal seal by engagement of a solid body seal to the wellhead housing, which metal-to-metal seal seals by weight force on the solid body hanger and provides back-up for one or more elastomeric seals of the solid body hanger to help ensure no fluid flows either way around an outside of the solid body hanger.

* * * * *